US007373915B1

(12) United States Patent
Joniec

(10) Patent No.: US 7,373,915 B1
(45) Date of Patent: May 20, 2008

(54) MOTION CONTROL MECHANISM FOR A PISTON ENGINE

(76) Inventor: Alexander F. Joniec, 110 Interlachen Ct., Aiken, SC (US) 29803

( * ) Notice: Subject to any disclaimer, the term of this patent is extended or adjusted under 35 U.S.C. 154(b) by 79 days.

(21) Appl. No.: 11/527,433

(22) Filed: Sep. 26, 2006

(51) Int. Cl.
*F02B 75/32* (2006.01)
*F02B 75/04* (2006.01)

(52) U.S. Cl. ..... 123/197.1; 74/40

(58) Field of Classification Search ..... 123/197.1, 123/197.4; 74/40, 44
See application file for complete search history.

(56) References Cited

U.S. PATENT DOCUMENTS 2,659,351 A * 11/1953 Chronic et al. ..... 123/197.4
3,633,429 A 1/1972 Olson
3,908,623 A 9/1975 McWhorter
4,463,710 A 8/1984 McWhorter
4,584,972 A 4/1986 Jayne et al.
4,890,588 A 1/1990 Tillman
5,156,121 A 10/1992 Routery
5,245,962 A 9/1993 Routery
5,724,935 A 3/1998 Routery
6,701,885 B2 3/2004 Klomp et al.
7,174,863 B2 * 2/2007 Scalzo ..... 123/48 B

* cited by examiner

*Primary Examiner*—Noah P. Kamen
(74) *Attorney, Agent, or Firm*—Michael A. Mann; Nexsen Pruett, LLC

(57) ABSTRACT

An improved piston engine includes a rocker arm and a connecting link between the piston rod and the crankshaft to allow its motion to be altered from that of the classic piston engine in order to overcome inherent limitations of the latter and realize greater efficiency. By inserting these two components between the end of a rigidly attached piston rod and a conventional crankshaft, the motion of the piston with respect to the crankshaft can be altered in important ways. For example, the dwell at top dead center can be increased relative to dwell at bottom dead center to the point where they are equal or in fact where dwell at top dead center is greater. Furthermore, because the piston rod is not directly connected to the crankshaft, ignition of the fuel can be timed to occur before top dead center so that pressure is maximized at top dead center in order to improve efficiency. Furthermore, the piston stroke can be shortened and slowed by the geometry of the rocker arm, thus increasing engine life.

20 Claims, 10 Drawing Sheets

MOTION CONTROL MECHANISM FOR A PISTON ENGINE

CROSS REFERENCE TO RELATED PATENTS

Not applicable.

BACKGROUND OF THE INVENTION

The present invention relates to a motion control system and method for use in converting reciprocating motion of a piston to a more efficient rate of travel in proportion to crankshaft travel. This system and method are applicable to all known classic reciprocating internal combustion engines, external combustion steam engines, and can be used to integrate pneumatic and hydraulic pumps into the design.

The piston and crankshaft have been an important part of engines and pumps for scores of years. Numerous improvements have been made to the classic piston engine, including better materials, better lubricants, and improved fuel injection systems. However certain problems remain that are inherent in the classic piston engine. These problems arise because of geometrical limitations on the relationship between the piston and the crankshaft of the conventional piston engine.

In typical reciprocating engines the arcuate distance traveled by the piston rod/crankshaft connection is 1.57 times the piston stroke. Also, in classic engines, the piston travels much faster at top dead center than it does at bottom dead center due to mechanical geometric constraints. This difference in piston dwell (or rate of travel) between top dead center and bottom dead center can be as much as 60%. (Piston dwell is defined as the time taken for a fixed percentage of piston travel of total stroke.) Accordingly, piston travel is further in the first 90 degrees, as much as 15% further in the first 90 degrees than in the second 90 degrees, or the halfway point through the stroke travel.

In addition, in classic engines, the rod angularity at top dead center (angle between the major dimension of the rod and the radius of the crankshaft where the rod joins to the crankshaft at the crank arm) is 0 degrees, so in spite of high cylinder pressure, the piston cannot effectively apply useful torque into turning the crankshaft at the piston top dead center. As a result, the typical peak cylinder pressures are calibrated or timed to arrive at approximately 15 crankshaft degrees (out of 360 degrees) after top dead center so that the crankshaft and rod angularity are in position to effectively leverage the working pressure into applying torque to the crankshaft. Inevitably, this delay results in a failure to use the critical top dead center highest cylinder pressure into doing work. These higher cylinder pressures at top dead center drop precipitously as the piston travels down the bore. As the piston moves, the volume displacement increases, thus lowering the pressure at an approximate 1 to 1 ratio. For example, when the pressure is initially 500 psi at top dead center of a cylinder displacement of 30 cubic inches with a combustion chamber size of 3 cubic inches, and the piston then continues to move as little as around 15 degrees, the displacement would increase to 3.578 cubic inches, when the piston continues to move as little as 15 degrees, the piston displacement will increase to 0.578 cubic inches for an increase of approximately 20% to the combustion size, thus taking the same starting 500 psi pressure and dropping it to 304 psi. As the piston continues to move further, pressure continues to drop at a very fast rate. If the delay in peak pressure calibration timing is designed to be later in the cycle to permit the rod angularity to become more optimal for torque conversion, additional fuel energy is needed to compensate for the additional displacement beyond the 15 degrees of piston travel to maintain the same combustion PSI. In addition, this delayed gas cylinder pressure energy can vent out of the exhaust valve/port opening, lowering the expansion ratio of the combustion gases. In short, much of the potential energy is not properly utilized during the first 45 degrees of the power cycle, when the peak cylinder pressure is the highest, the result of the inherent design limitations with the classic combustion engine.

Thus there remains a need for a way to avoid these inherent design limitations of classic piston engines and pumps.

SUMMARY OF THE INVENTION

According to its major aspects and briefly recited, the present invention is an improved piston engine, and a piston engine improved by the addition of a mechanism that allows the relationship between piston motion and crankshaft motion to be altered from that of the classic piston engine so that the limitations of that engine are overcome and more power can be realized when using the same fuel energy. By inserting basically two main components between the end of a rigidly attached piston rod and the crankshaft, namely, a unique rocker arm and a connecting link, the motion of the piston with respect to the crankshaft can be altered in important ways, ways that allow a more efficient transfer of energy between the moving piston and the rotating crankshaft over the classic crankshaft and connecting rod configuration.

In addition there are three areas of improvement that are also included in this invention. 1. By not having the piston move while combustion is taking place, the combustion chamber shape can be better optimized. 2. Substantially less additional surface area is exposed during the combustion process and power stroke to lose heat energy too. 3. Due to the unique configuration and method of the component placement, the invention permits different placement of the crankshaft TDC and the piston TDC which permits the TDC cylinder pressure to effectively leverage it into producing useful torque both sooner in the power stoke and with more advantageous rod angle that produces more torque at the same cylinder pressure.

This result is counter-intuitive for two reasons. First, adding additional parts, with their inherent contributions to the friction of the system would be expected to reduce overall efficiency. Second, engines coupling pistons and crankshafts have been in widespread use for a long time particularly during times when improvements in the efficiency of combustion engines were eagerly sought to improve fuel economy. To suggest that adding components, which are unknown in the prior art despite the considerable incentive to improve combustion engines, would improve efficiency not just incrementally, but significantly—by as much as 20% or more—is a highly non-obvious result.

The increase in efficiency is more than enough to compensate for the additional friction of these components introduce, and comes from several sources. First, the rate of travel of a piston with respect to the different segments of its cycle can be altered from that of a classic piston engine. For example, the rate of travel can be made slower at the top of the cycle and faster at the bottom, the opposite of prior art piston engines, or made the same speed at both of the cycle top and bottom. The present design allows the rate of piston travel to be adjusted to achieve the designer's requirements. When slowed as the piston moves toward top dead center, both less fuel in needed and the combusting fuel has more time to build pressure with a smaller combustion chamber volume as the result of the piston not moving during the combustion process. In a standard piston engine, the gas is still combusting as the piston is well-along in its down stroke. Accordingly, the pressure does not build to the same levels of PSI as in the present invention. In addition the present invention maintains a higher cylinder pressure over a longer period of optimum crankshaft travel of the first 45 degrees of the power stroke, for a higher average PSI when starting with the same PSI as a classic configuration.

A piston engine according to the present invention can be designed to slow or even pause in the movement of the piston so that combustion has a chance to go to completion before the cylinder travels very far from top dead center. Moreover, the present mechanism allows the cylinder to fire when the engine designer wants the cylinder to fire, including in advance of top dead center, for maximum pressure if so desired. When timing the firing before top dead center using the present invention, there is little to no negative work being done as the piston is already at or near TDC and does not have to oppose any pressure as in a classic engine design.

By carefully adjusting the geometry of the major components of the new system: length of the piston rod, lengths of the two portions of the rocker arm with respect to its fulcrum, length of the connecting link, and radius of the point of attachment of the piston rod to the eccentric on the first portion of the rocker arm, engines with differing performance characteristics will result. Knowing the requirements for the engine to be designed, the engineer can begin with a suitable arrangement, model it by computer, optimize it for the particular design, and then build and test the prototype engine.

In addition to increases in efficiency, the present system and method makes new arrangements of engines possible by taking advantage of the possible orientations of piston to crankshaft.

These and other features and their advantages will be apparent to those skilled in the art of engine design from a careful reading of the Detailed Description of Preferred Embodiments accompanied by the following drawings.

DETAILED DESCRIPTION OF THE INVENTION

Figure 1:
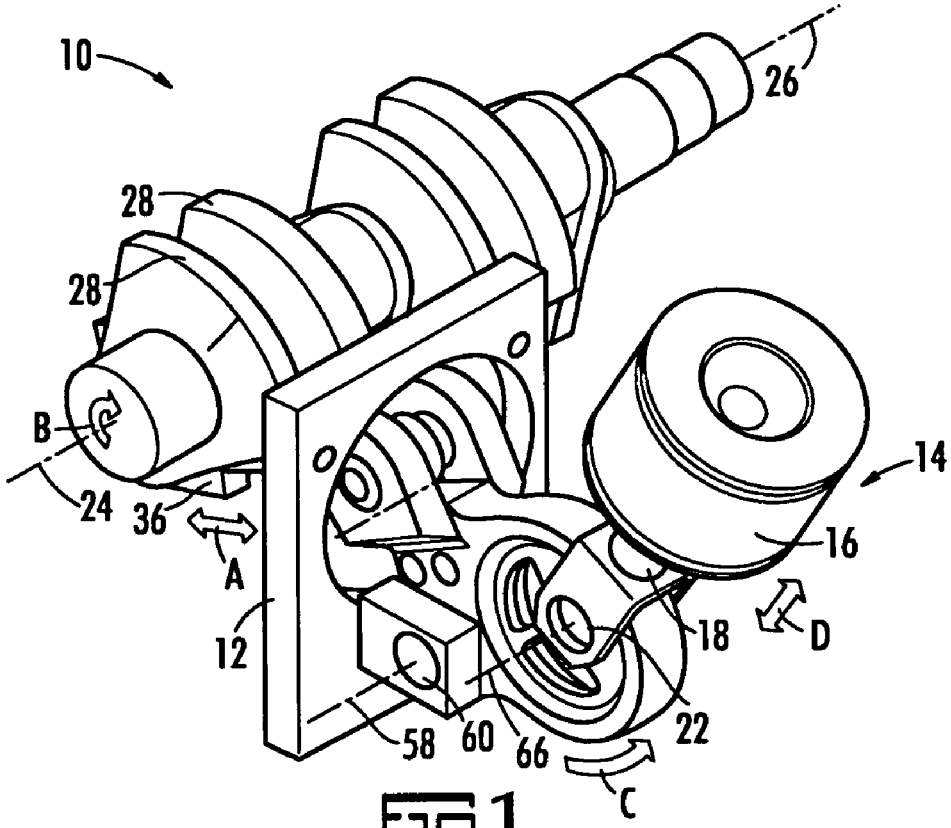
FIG. 1 is a perspective view of an engine that includes a rocker arm and connecting member for controlling the motion of the piston and the crankshaft, according to a preferred embodiment of the present invention.

The present invention is an improved engine. The present invention improves that prior art, or "classic," piston/crankshaft arrangement that is a part of many engines and pumps. The improvement, as will be explained in more detail below, comprises the insertion of two components between the piston rod and the crankshaft in order to allow the engine designer to alter the geometric relationship between the piston and the crankshaft, and, with that altered geometry, the mechanical performance characteristics of the engine or pump. In particular, the engine designer can change the piston stroke length, the overall rate of travel of the piston, the instantaneous rates of piston movement as it goes through its cycle so that some portions of the travel are slower and others faster than before, and change the angle between the direction of piston motion (coincident with the long axis of the piston) and a line perpendicular to the axis of the crankshaft.

By slowing the relative rate of piston movement as it nears top dead center and speeding it up at bottom center compared to the classic piston/crankshaft movement and by changing the angle between the piston and the crankshaft, the pressure from the combustion of the fuel can be maximized, and thus more chemical energy can be converted to applying mechanical torque to the crankshaft. Other improvements and their advantages, as will be described, are also possible.

The present improvement will be described broadly in view of the fundamental way it alters conventional piston/crankshaft mechanics. To illustrate the invention, a specific engine configuration will be described and illustrated with one piston when in fact multiple pistons (typically two or four) would likely be used in any particular application. The results of parametric studies on this specific engine configuration will be shown and described to illustrate how adjustments in the geometry of the two added components can result in variations in the performance of an engine or pump. Then different arrangements of engines are also illustrated and described. However, it will be clear to those of ordinary skill that the number of variations in the geometric arrangements is infinite.

Beginning with a knowledge of the basic inventive concept from the teachings herein, it is expected that an engine designer, presented with various design objectives for a new engine or pump, will be able to meet those objectives using the inventive design, but, as in the case of designing any new engine, a reasonable amount of design and engineering, assisted by computer modeling and prototype testing, will be required to produce a good final design.

The present invention can be used for both engines and pumps. For simplicity in the presentation of the description of preferred embodiments, a reference to an engine, except where the context makes it clear that a combustion or steam engine or pump is specifically intended, shall also be construed to refer also to an engine operated on by expanding fluid and to a pump wherein the crankshaft is turned in order to use the pistons to pump a pneumatic or hydraulic fluid. The term fluid is intended to include both liquids and gases.

The present invention is most useful in industrial, two- and four-cycle engines and pumps that operate for long periods at relatively fixed RPM, or revolutions per minute (RPM), such as engines for power generation, pneumatic and hydraulic pumps, and industrial and marine applications. For simplicity, engine blocks with cylindrical holes for the pistons and means for delivering fuel/air mixtures such as valves and injectors, are not shown in the illustrations. These are conventional components, well-known to engine designers, and will be simply identified as a "engine block" when shown in the figures which is defined to include the engine block with its holes for pistons, fuel delivery means (injectors or valves).

The present invention is an improved engine and a method of altering the geometric characteristics of an engine, and a method of improving the efficiency of an engine, a method of increasing engine durability. The improvement lies in the insertion of a rocker arm and connecting link between the piston and the crankshaft and in the rigid attachment of the piston rod to the piston head. These changes from the traditional engine yield two broad advantages, notwithstanding the obvious disadvantages of increasing complexity, friction and cost. First, it gives the designer new variables to use to adjust the characteristics of the engine's performance. Judicious choice of the geometric parameters that affect these performance characteristics can result in engines with increased efficiency, power or durability or combinations of these, such as, for example, up to 35% higher average pressure in the first 45 degrees of the power stroke when starting with the same peak combustion pressure. Second, these two additional components allow the orientation of the crankshaft with respect to the piston to be changed, thus yielding greater flexibility in designing engines to meet design requirements for alternative fuels with their different expansion rates and unique combustion characteristics.

As an example of this new flexibility which will be described in greater detail below, engines can be designed that have equal travel at the half-way point of the stroke, an arrangement not possible with the classic piston engine.

Figure 2:
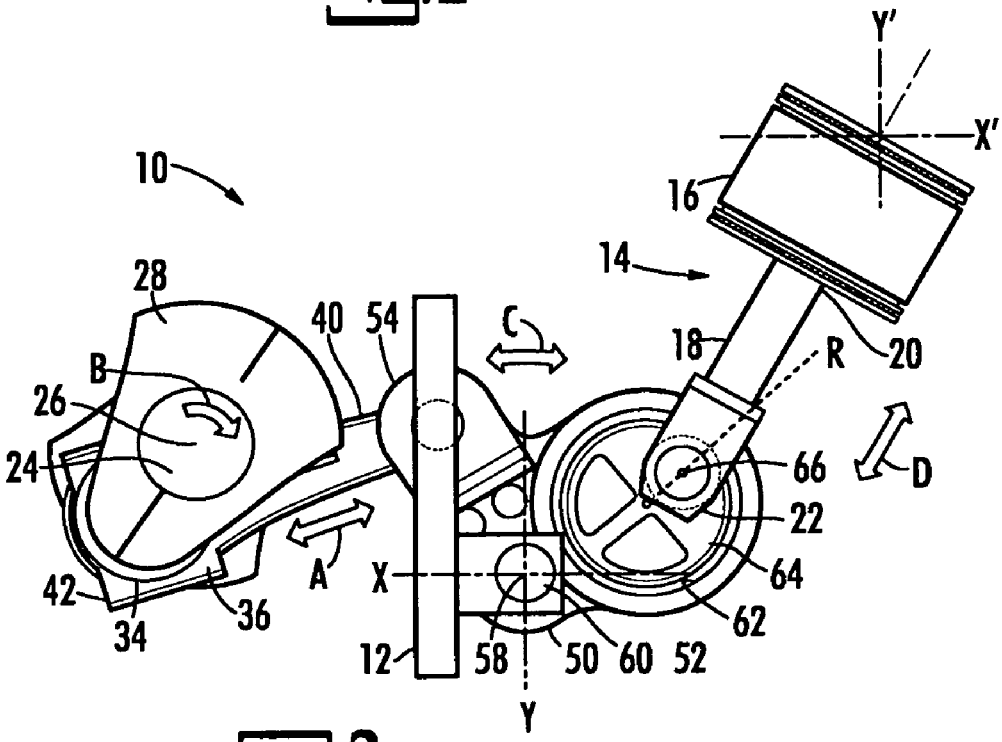
FIG. 2 is a side view of the engine of FIG. 1.
Figure 3A:
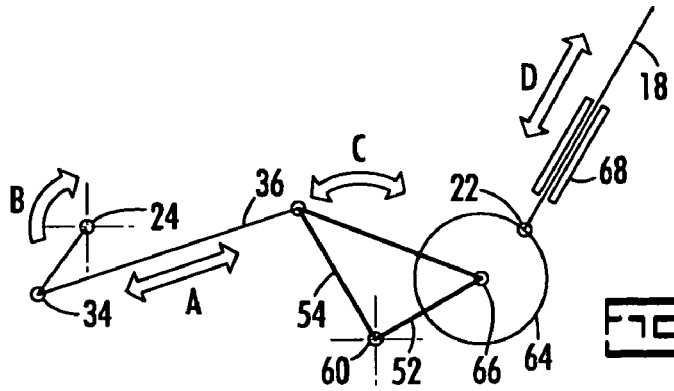
FIGS. 3A-3L are schematic illustrations showing, in 12 incremental, sequential steps, the motion of the piston 18, first and second portions 52, 54, of rocker arm 50 with its eccentric 64, connecting link 36 and crankshaft 24 of the engine shown in FIGS. 1 and 2 through a complete cycle of crankshaft 24, according to one embodiment of the present invention.
Figure 3B:
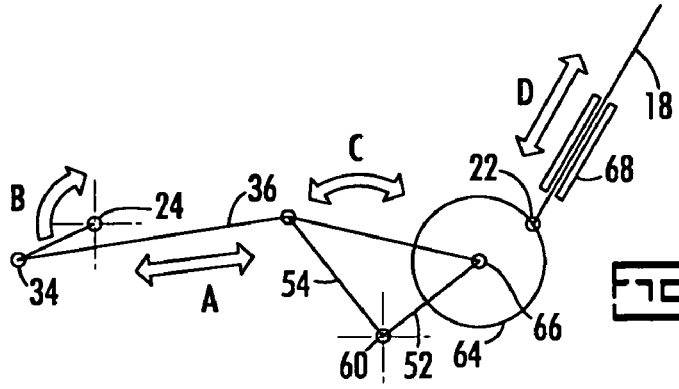
Figure 3C:
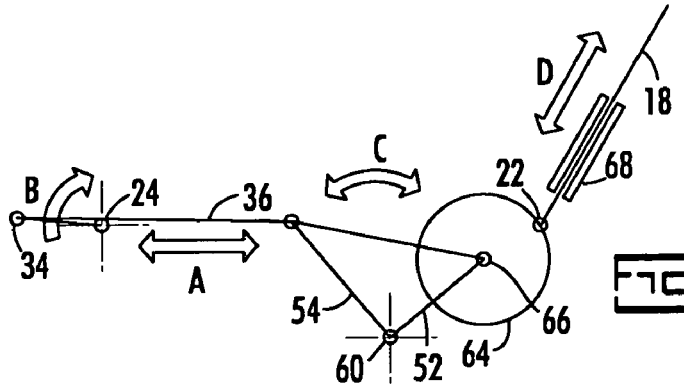
Figure 3D:
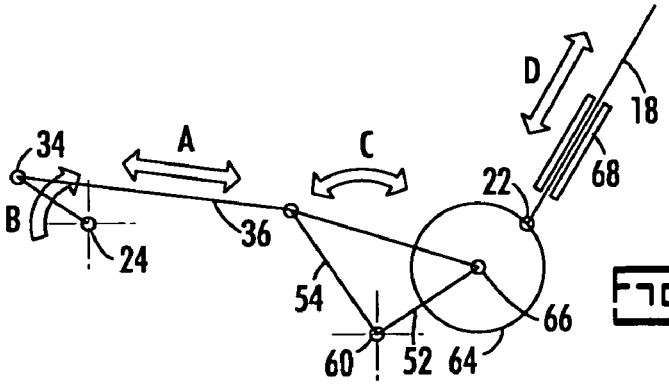
Figure 3E:
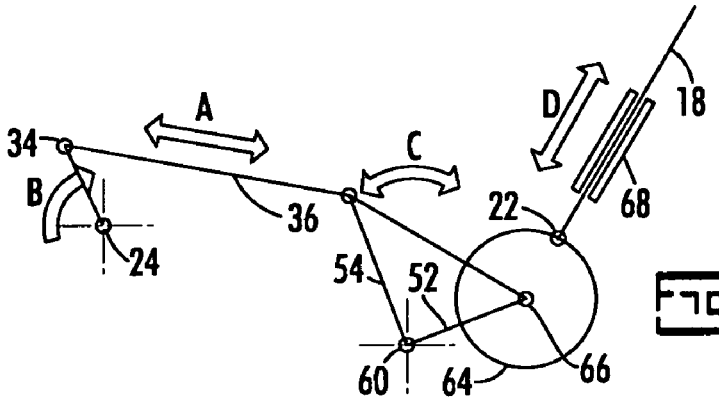
Figure 3F:
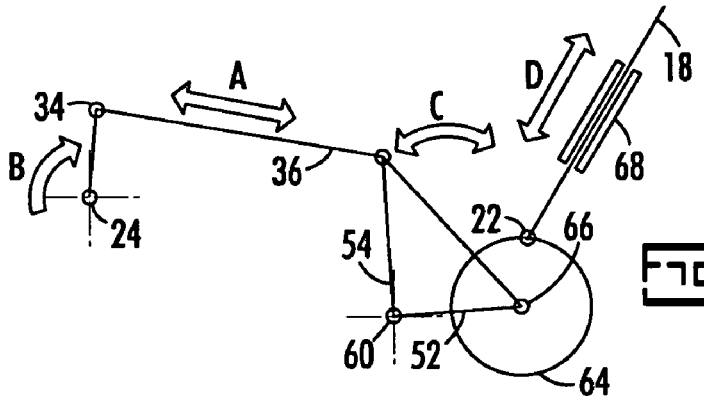
Figure 3G:
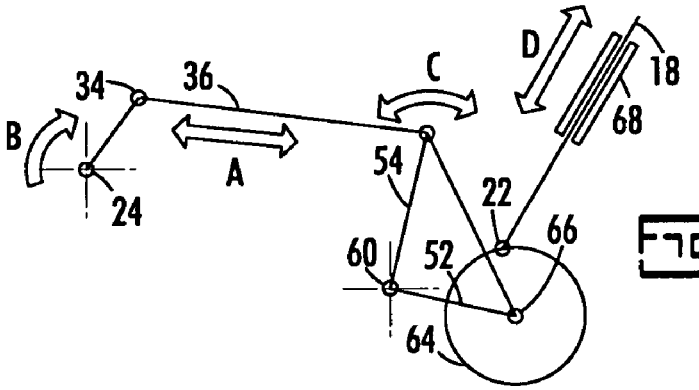
Figure 3H:
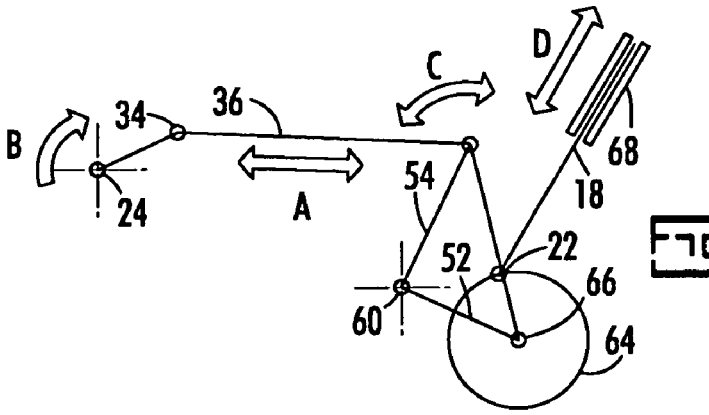
Figure 3I:
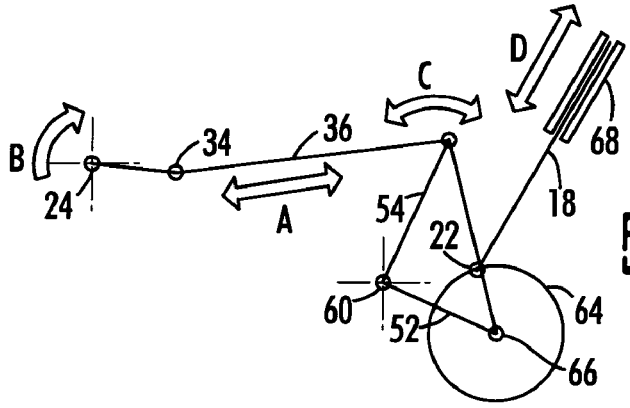
Figure 3J:
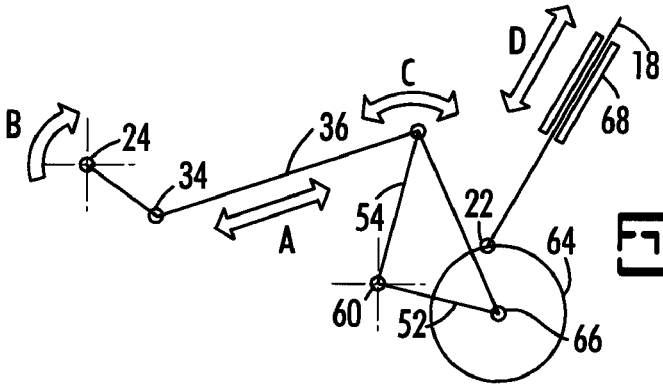
Figure 3K:
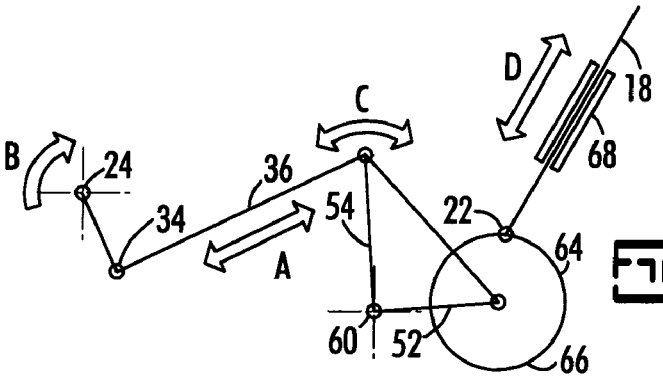
Figure 3L:
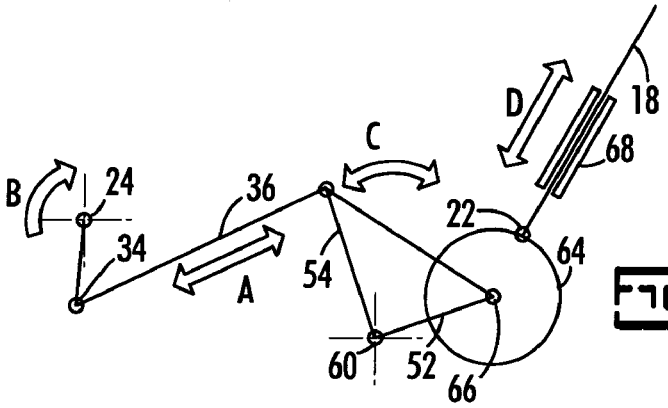

Referring now to FIGS. 1 and 2, there is shown, in perspective and in side views, a portion of an engine according to a preferred embodiment of the present invention, and generally indicated by reference number 10. Engine 10 includes an engine block 12 that is stationary with respect to the observer riding on engine 10. Engine 10 includes a piston 14 having a piston head 16 and a piston rod 18. The cylinder that would house piston 10 is omitted from FIGS. 1 and 2 for simplicity but would otherwise be conventional, as would also be valves or injectors for introducing fuel and air into the space between piston head 16 and the cylinder and piston rings, and is therefore represented simply by engine block 12. Rod 18 has a first end 20 and an opposing second end 22

Engine 10 includes a crankshaft 24 which rotates about an axis 26. Counterweights 28 alternate with crank arms 34 along axis 26 of shaft 24 and permit crankshaft 24 to be rotated about axis 26. A connecting link 36 having a first end 40 and an opposing second end 42 is rotatably attached at its second end 42 to crankshaft 24 at crank arm 34. As connecting link 36 reciprocates in the direction shown by arrow A on FIGS. 1 and 2, its second end 42 revolves around axis 26, as indicated by the direction of Arrow B, aided by the movement of counterweights 28.

Between rod 18 and first end 40 of connecting link 36 is a rocker arm 50. Rocker arm 50 has a first portion 52 and a second portion 54, preferably integrally connected to each other at an angle. Rocker arm 50 is pivotally attached to engine block 12 so that it is free to rock back and fourth about an axis 58 through a pivot pin 60, as indicated by Arrow C (FIG. 2). Pivot pin 60 thus acts as a fulcrum about which first portion 52 and second portion 54 can pivot. The lengths of first portion 52 and second portion 54 do not have to be equal and, indeed, it is advantageous for them to be unequal and for second portion 54 to be the longer of the two because second portion 54 has to provide sufficient stroke for connecting link 36 to rotate 360° around crankshaft 24 but piston 14 does not have to rotate 360° around eccentric 64. Therefore, said first portion 52 need not move as much as second portion 54. In a classic engine, the ratio of the arcuate distance of travel of the piston rod/crankshaft connection to piston stroke length is approximately 1.57; in the present invention the arcuate distance of travel of the connecting link/crankshaft connection to piston stroke length is greater than 1.57 and more than likely much greater.

First portion 52 and second portion 54 can be in line, that is, at an angle of 180° or be arranged at an obtuse angle, less than 180°.

First portion 52 is formed with a hole 62 to receive an eccentric 64 rotatably mounted within hole 62. Eccentric 64 is pivotably connected to second end 22 of rod 18 at a point off the central rotational axis 66 of eccentric.

Second portion 54 of rocker arm 50 is pivotally attached to first end 40 of connecting link 36. It will be readily appreciated that, as piston 14 moves in the direction of Arrow D, its second end 22, being rigidly held in its cylinder and pivotally attached to eccentric 64, causes eccentric 64 to oscillate and rocker arm 50 to rock, as indicated by arrow C, in compensation for the reciprocal movement of piston 14.

This movement is illustrated in FIGS. 3A-3L schematically. The series of figures, FIG. 3A to FIG. 3L show the components as lines or circles for simplicity and show how they move with respect to each other through a complete cycle in eight steps. The reference numbers used in FIGS. 1 and 2 are used in FIGS. 3A-3L to simplify the understanding of the movement. By examining FIGS. 3A-3L in the order presented, the movement of engine 10 can be appreciated. Piston rod 18 moves up and down, reciprocally, in its stationary cylinder 68. As piston rod 18 reciprocates, its second end 22, being pivotally attached to eccentric 64, causes first portion 52 of rocker arm 50 to rock about axis 58. As rocker arm 50 rocks, second portion 54 rocks at the same rate and eccentric 64 oscillates within first portion 52 to compensate for the lateral displacement of axis 66.

Second portion 54 of rocker arm 50, which is pivotally connected to first end 40 of connecting link 38, causes connecting link 36 to reciprocate.

Connecting link 36 is connected to crankshaft 24 much as a traditional piston rod is connected to a traditional crankshaft; that is, second end 42 of connecting link 36, attached rotatably to crankshaft 24 at crank arm 34 and will rotate crankshaft 24 about axis 26 with the help of counterweights 28. Thus it will be seen that instead of a pivotally attached piston rod directly rotating a crankshaft about the crankshaft axis, as in the prior art, classic piston engine, the connecting link of the present invention becomes the pivotal piston rod and in its place is a rigidly attached piston rod 18, with rocker arm 50 inserted there between.

The physical changes provided by the present invention decouple the otherwise rigid connection between the crankshaft and the piston, and introduce useful control flexibility over the relationship between crankshaft movement and piston movement, and also add mechanical flexibility to the engine design itself. Note that, for example, rocker arm 50 allows the piston stroke of the engine of FIGS. 1-3 to be shorter and thus slower than in a classic piston engine. The ratio of the length of first portion 52 of rocker arm 50 to the length of second portion 54 determines the stroke of connecting link which of course has to be sufficient to rotate crankshaft 24. However, piston 14 does not have to rotate eccentric 64 through a full 360° but only a small part of it. The shorter and slower reciprocation of piston 14 reduces wear and, accordingly, increases the operating life of engine 10.

Beginning with the control flexibility, as best seen in charts showing piston stroke versus crankshaft degrees, FIGS. 4-7 illustrate parametric studies showing how control over the motion of piston 14 and crankshaft 24 can be modified by small changes in the physical arrangement of the components of engine 10. These variables include (1) the location of axis 58 about which rocker arm 50 pivots, which can be moved in the x or y direction (see FIG. 2); (2) the relative lengths of first and second portions 52, 54 as measured from axis 58; (3) the radius at which second end 22 of rod 16 is located with respect to axis 66 of eccentric 64; and the lateral offset of piston 14 with respect to axis 66.

Figure 4:
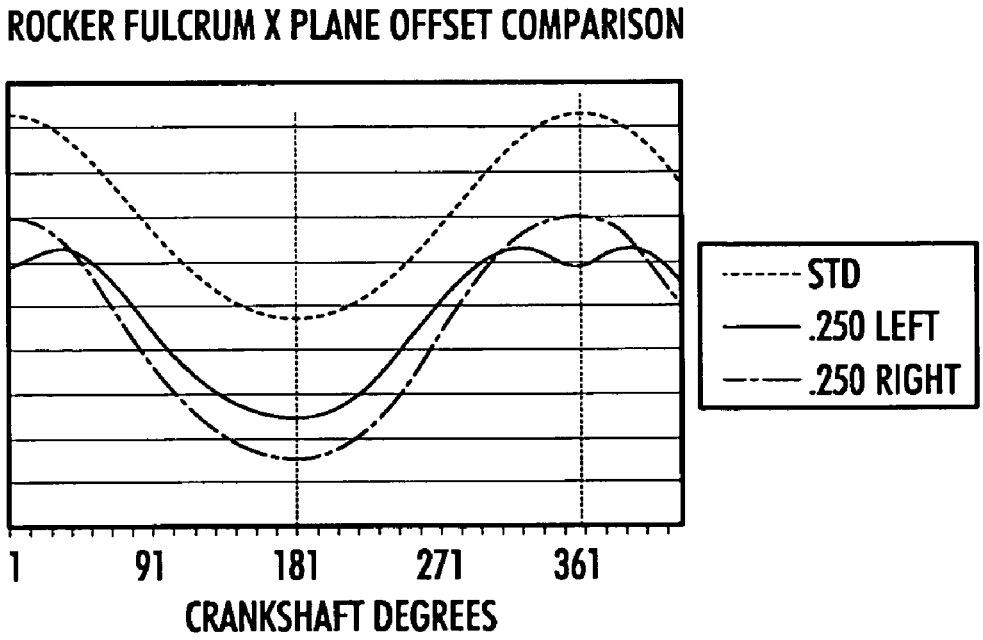
FIG. 4 is a chart of rod displacement as a function of crankshaft degrees for the engine of FIGS. 1 and 2, showing displacement as a function of crankshaft degrees for the engine of FIGS. 1 and 2, with the rocker fulcrum offset by 0.250 inches to the left, and offset by 0.250 inches to the right.
Figure 5:
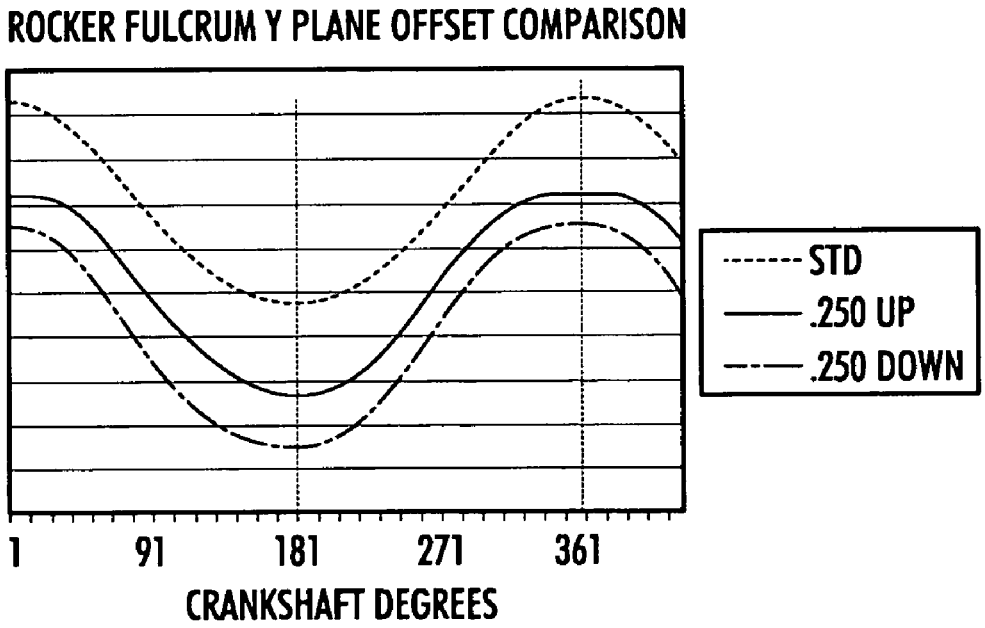
FIG. 5 is a chart of rod displacement as a function of crankshaft degrees for the engine of FIGS. 1 and 2, showing displacement as a function of crankshaft degrees for the engine of FIGS. 1 and 2, with the rocker fulcrum moved vertically by 0.250 inches, and moved down by 0.250 inches.

FIGS. 4 and 5 show the motion of piston 14 versus crankshaft degrees for the present engine as illustrated in FIGS. 1 and 2, and for two geometric variations of it in each figure. In each figure, the standard (STD) trace is the same. In FIG. 4, piston motion versus crankshaft degrees is shown with axis 58 moved 0.250 inches to the left (solid line) and 0.250 inches to the right (dot-dash line) from its nominal point of attachment as shown in FIG. 2. In FIG. 5, axis 58 has been moved 0.250 inches up (solid line) and 0.250 inches down (dot-dash line) from its nominal point of attachment. No other changes in any of the variables were made.

As evident from three traces of FIG. 4, movement of axis 58 to the left tends to shorten the stroke and to flatten the trace at top dead center. This result reflects the increased ratio of second portion 54 to first portion 52. In FIG. 5, movement of axis 58 up also tends to flatten the trace at top dead center for the same reason.

Figure 6:
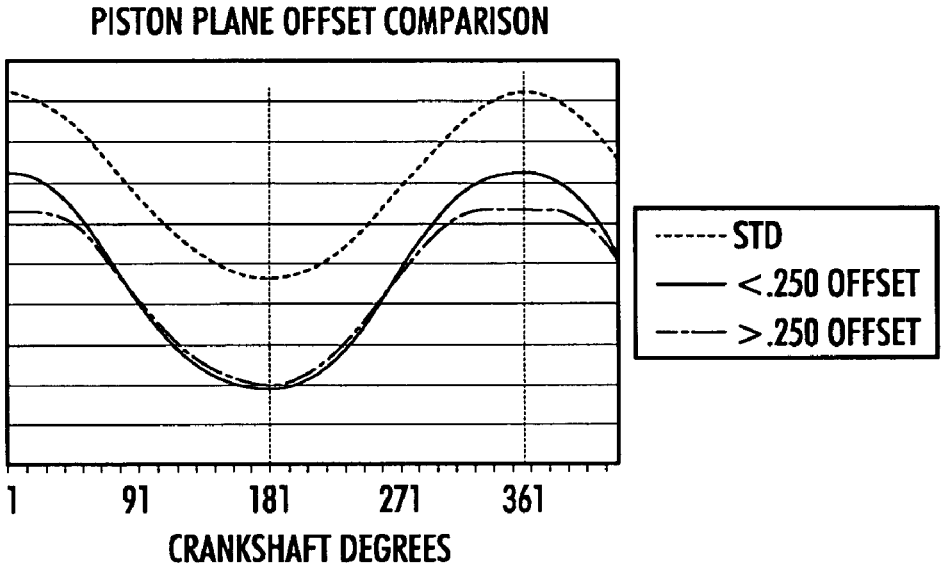
FIG. 6 is a chart of rod displacement as a function of crankshaft degrees for the engine of FIGS. 1 and 2, showing displacement as a function of degrees For the engine of FIGS. 1 and 2, with the piston plane offset by a little less than 0.250 inches and offset by a little more than 0.250 inches.
Figure 7:
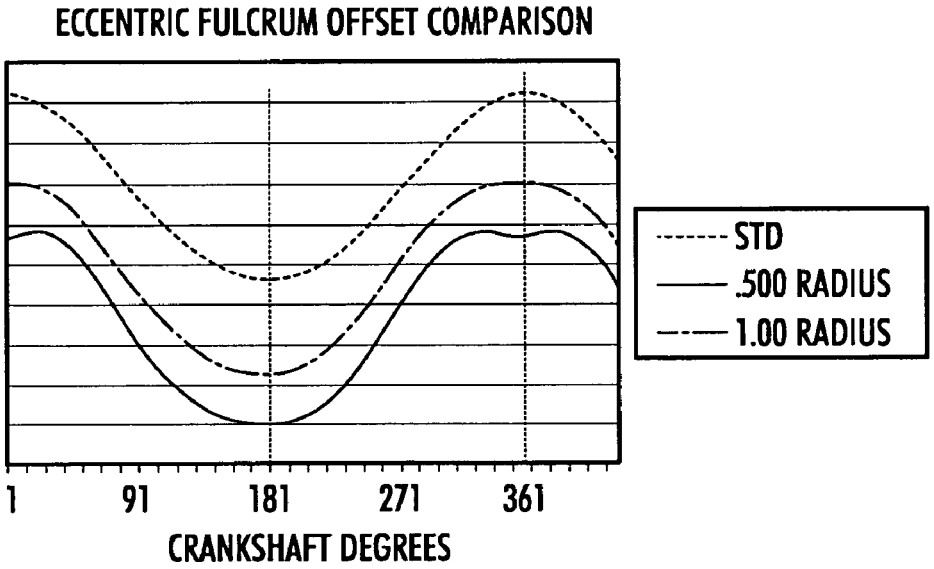
FIG. 7 is a chart of rod displacement as a function of crankshaft degrees for the engine of FIGS. 1 and 2, showing displacement as a function of degrees for the engine of FIGS. 1 and 2, with the eccentric fulcrum moved by 0.500 radius, and moved by 1.00 radius.

FIGS. 6 and 7 illustrate traces of the stroke versus crankshaft degrees for the engine configuration of FIG. 2 and for variations of it in each figure, namely, when the piston plane is offset and when the eccentric fulcrum is moved. In FIG. 6, for example, the offset of the plane of piston 14 is decreased to the left by 0.250 inches (solid line) and increased to the right by 0.250 inches (dot dash line). In FIG. 7, the eccentric fulcrum offset is decreased by half a radius (solid line) and increased by a full radius (dot dash line).

FIG. 6 illustrates that decreasing the piston plane offset increases piston travel; increasing piston offset flattens the trace at top dead center to allow the piston to remain at top dead center longer without travel. FIG. 7 illustrates that reducing the radius of the eccentric fulcrum by half a radius flattens the trace, i.e., reduces piston motion at top dead center.

Figure 8:
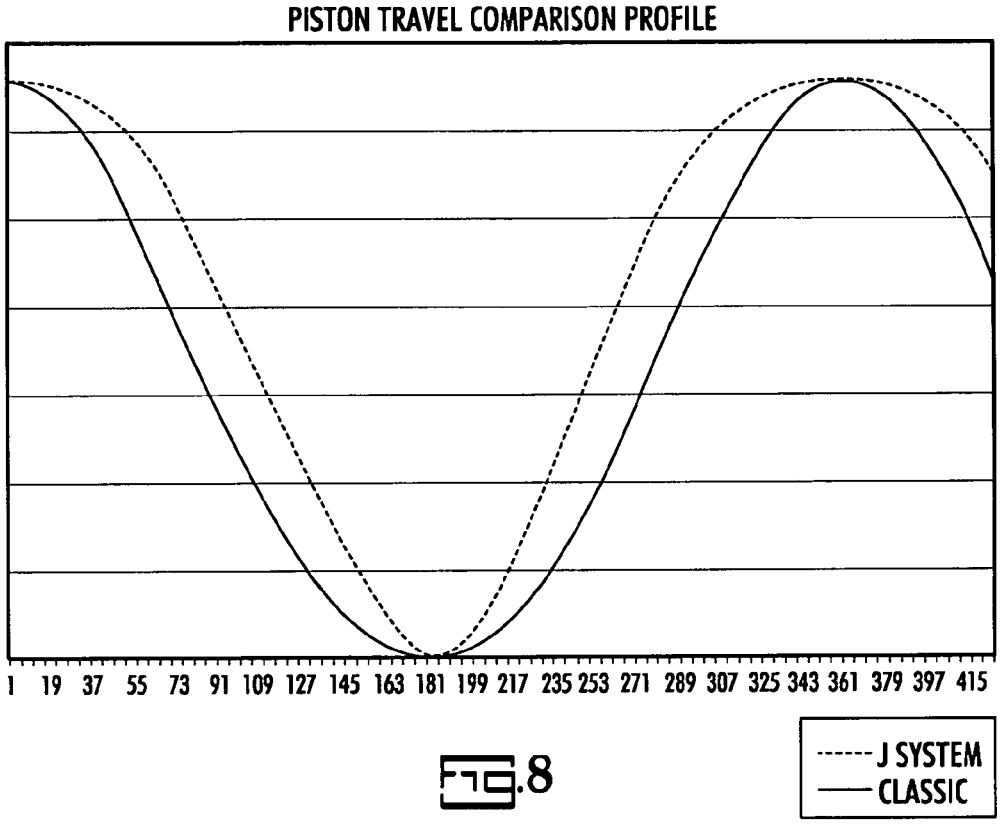
FIG. 8 is a chart of rod displacement as a function of crankshaft degrees for the engine of FIGS. 1 and 2, showing the piston rod position as a function of degrees of the engine of FIGS. 1 and 2, compared to the piston rod position as a function of degrees for a classic piston engine.

FIG. 8 compares the motion of piston 14 in the embodiment illustrated in FIG. 2, according to the present system, (dashed line) as a function of crankshaft degrees compared to a classic, prior art system (solid line) in which the crankshaft is connected directly to the piston rod. Note that the curves are reversed in that the piston in the present system spends relatively more time near top dead center and relatively less time at the bottom of the cycle compared to the traditional cycle. The advantage of this outcome is significantly increased engine power because a slower piston at top dead center allows combustion to go to completion and thus increases pressure in the cylinder to a greater extent before the piston travels as far down the bore of the cylinder in its down stroke. Furthermore, by suitable adjustment of the components, the curve of piston travel versus crankshaft degrees can be made symmetric top to bottom if so desired, which is well suited for double acting piston engines.

Also, because piston 14 is offset from rocker arm 50, there is no prohibition to timing the ignition of the fuel/air mix just prior to top dead center so that the peak pressure occurs at top dead center for maximum torque delivery. Accordingly, the present system is able to capture much more of the energy of the combusting fuel than the prior art, classic engine.

In addition to greater power output, the present invention permits design flexibility that may be needed to meet spatial requirements or may be used to create even more efficient engines. FIGS. 9-14 illustrate a variety of configurations of engine embodiments using the present invention and that are different from that illustrated in FIGS. 1 and 2.

Figure 9:
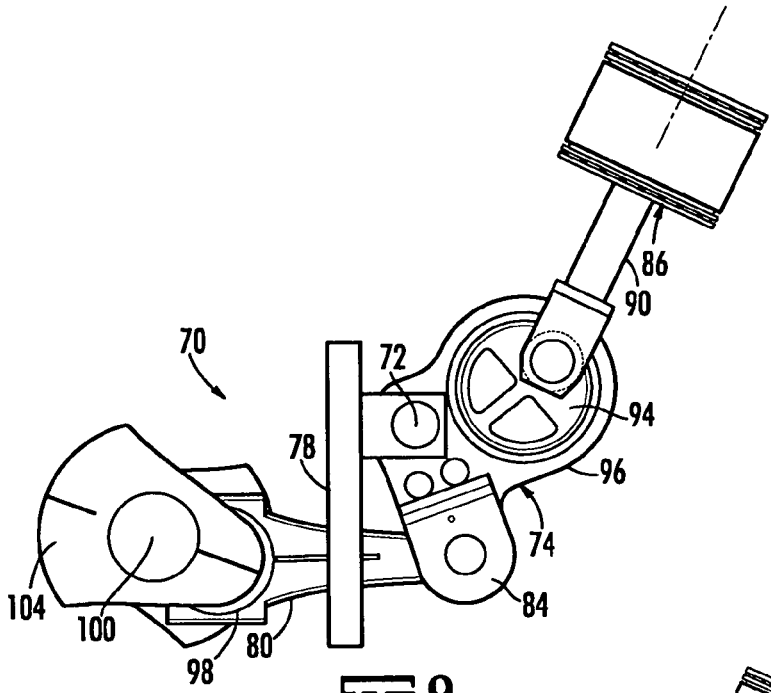
FIG. 9 is a side view of an alternative design of a piston engine with the addition of rocker arm and connecting link, having the rocker arm fulcrum secured high compared to that of the engine shown in FIGS. 1 and 2, according to a preferred embodiment of the present invention.

For example, in FIG. 9, an engine 70 is illustrated in side view that is similar to that of FIG. 2 but with the major difference of having the fulcrum 72 of rocker arm 74 attached to engine block 78 above the point at which connecting link 80 is attached to second portion 84 of rocker arm 74 rather than below it. Piston 86 includes a piston rod 90 that is attached to an eccentric 94. Eccentric 94 is in turn rotatably held in first portion 96 of rocker arm 74 and, as piston 86 reciprocates, rocker arm 74 rocks about fulcrum 72 and drives a connecting link 80 reciprocally. Connecting link 80 is attached to a crank arm 98 of a crankshaft 100 and, assisted by counterweight 104, rotates crankshaft 100.

Engine 70, unlike engine 10 which pulls on crankshaft 24 in the down stroke of piston 14, pushes on crankshaft 100 on the down stroke of piston 86. If engine 70 were operated as a pump, with crankshaft rotated by a source of power (electrical, for example), rocker arm 74 would push on piston 86

Figure 10:
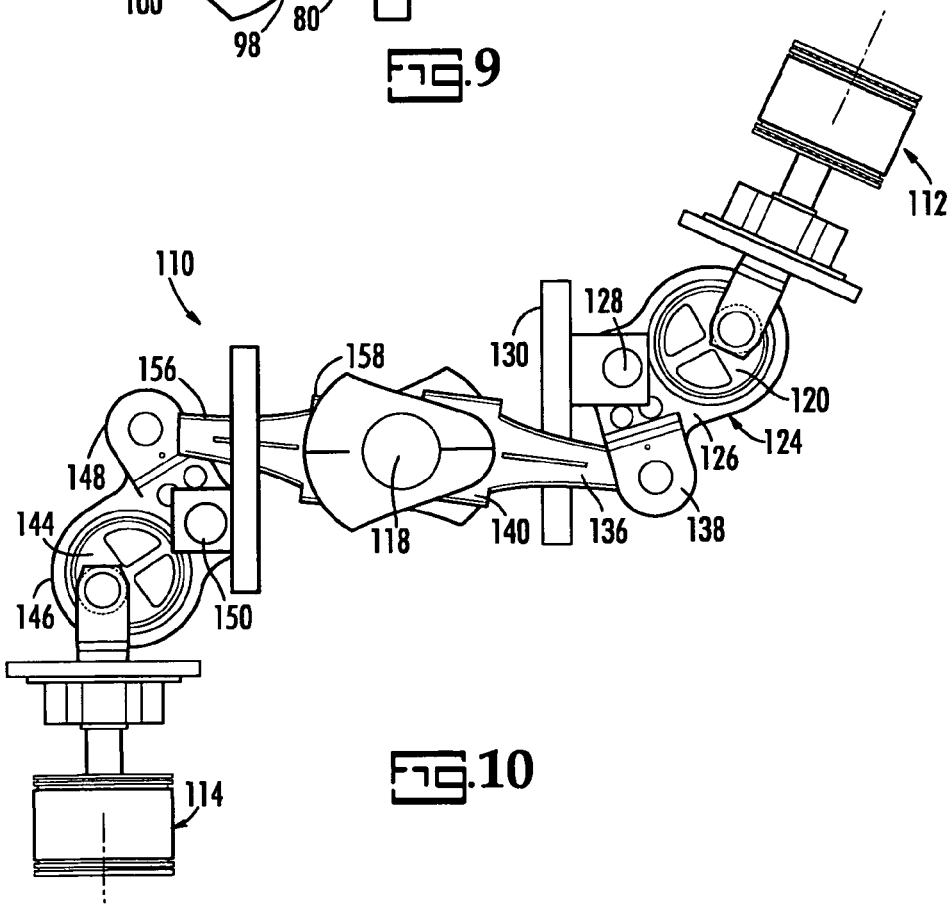
FIG. 10 is a side view of an engine design, with two pistons asymmetrically arranged, according to a preferred embodiment of the present invention.

FIG. 10 illustrates an engine 110 having a first and a second piston 112, 114 driving one crankshaft 118. First and second pistons 112, 114 are asymmetrically arranged. First piston 112 is connected to a first eccentric 120 rotatably held in a first portion 124 of a first rocker arm 126. First rocker arm 126 rocks about a first fulcrum 128 attached to an engine block 130 and reciprocates a first connecting link 136 through its second portion 138. First connecting link 136 is connected to crankshaft 118 via a first crank arm 140.

Second piston 114 is connected to a second eccentric 144 rotatably held in a first portion 146 of a second rocker arm 148. As second piston 114 reciprocates, it rocks second rocker arm 148 about a second fulcrum 150. Second end 152 of second rocker arm 148, which is held to engine block 130 causes a second connecting link 156 to reciprocate. As second connecting link 156 reciprocates, it causes crankshaft 118 to rotate via a connection at a second crank arm 158.

Figure 11:
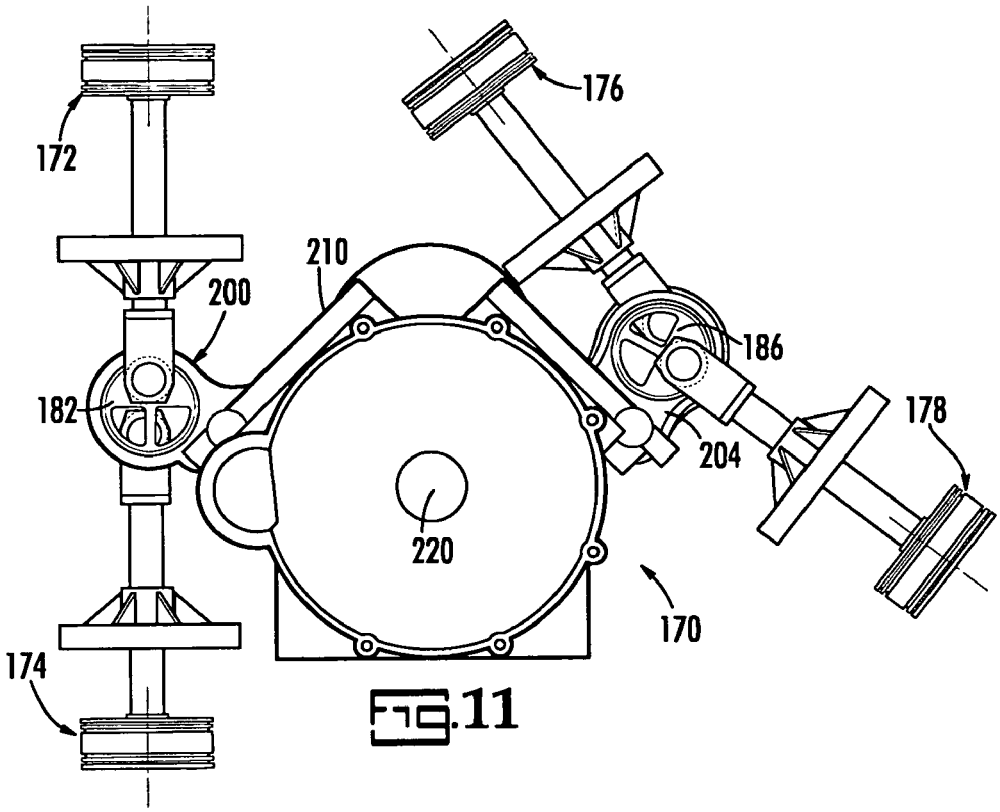
FIGS. 11 and 12 illustrate a side view and perspective view of a second alternative multi-piston engine design, with four pistons mounted in an asymmetric arrangement; according to a preferred embodiment of the present invention.
Figure 12:
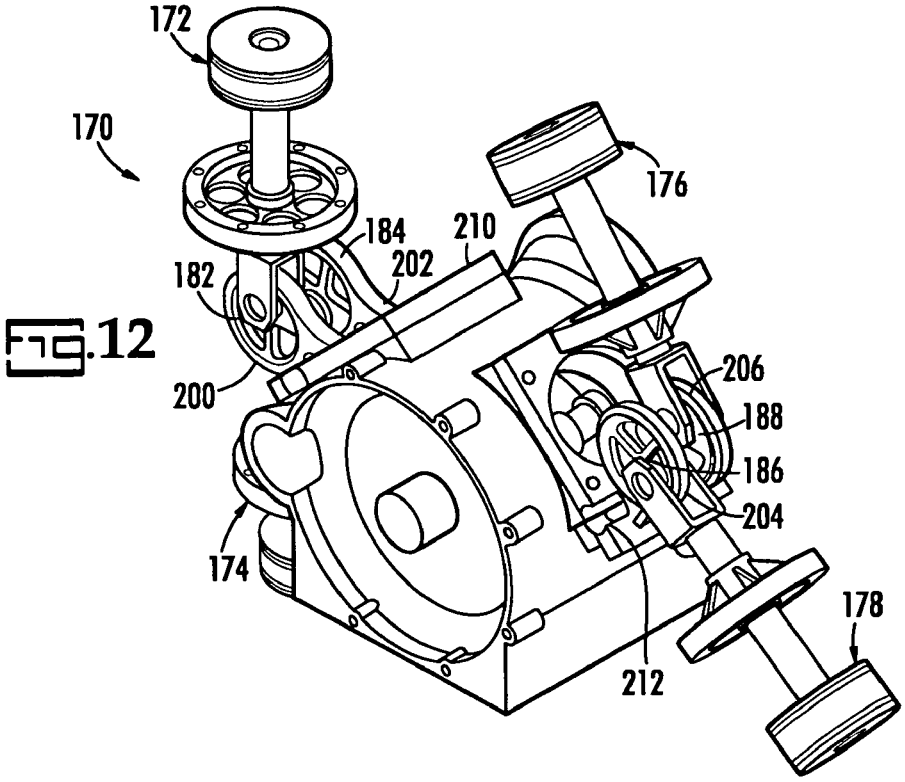

FIGS. 11 and 12 are side and perspective views of a four cylinder engine 170. Engine 170 is also asymmetric. Engine 170 has a first, second, third and fourth piston 172, 174, 176 and 178. Each piston 172, 174, 176, 178, is connected to an eccentric 182, 184, 186, 188, on a rocker arm 200, 202, 204, 206 pivotally attached to an engine block 210. Rocker arms 200, 202, 204, 206, are connected to connecting links (not shown) that rotate crankshaft 220 via crank arms (not shown) as described above.

Figure 13:
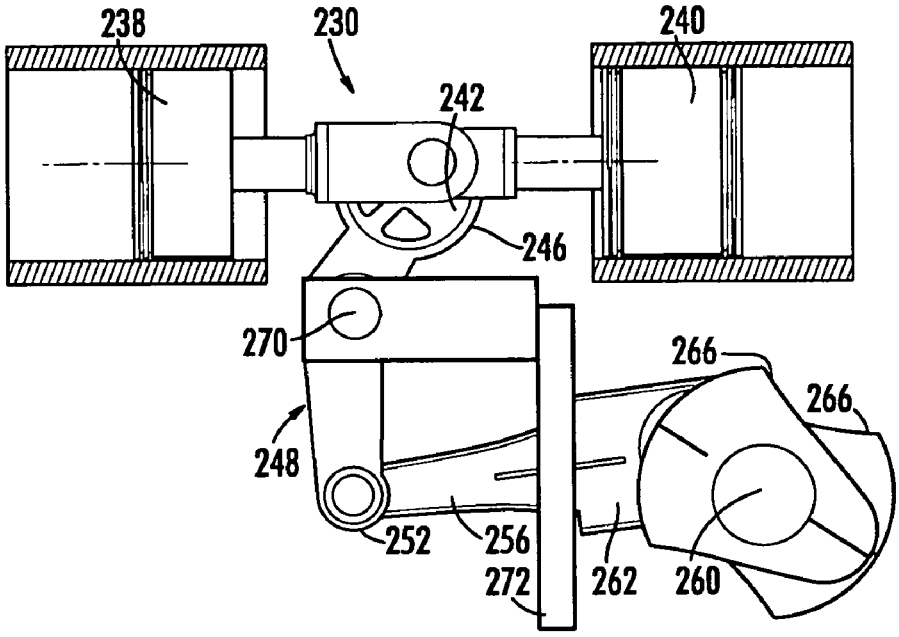
FIG. 13 illustrates a side view of a third, alternative multi-piston engine design with two pistons operating in an opposing, reciprocating relationship on a single rocker arm, according to a preferred embodiment of the present invention.
Figure 14:
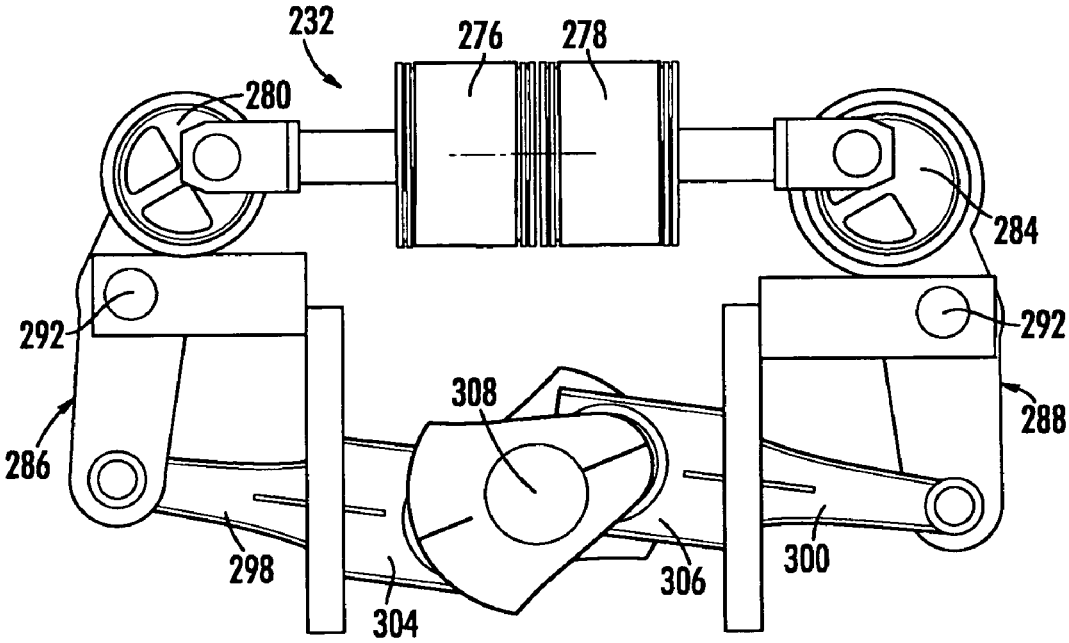
FIG. 14 illustrates a side view of a fourth alternative multi-piston engine design with two pistons operating in an opposing, nearly symmetrical relationship, according to a preferred embodiment of the present invention.

FIGS. 13 and 14 both show in-line piston engines 230, 232. Engine 230, shown in FIG. 13, has first and second pistons 238, 240, that operate in diametrically opposing directions and are pivotally attached to the same eccentric 242 on a first end 246 of a rocker arm 248. The opposing second end 252 of rocker arm 248 is pivotally attached to a connecting link 256 that rotates a crankshaft 260 via a crank arm 262, assisted by a counterweight 266. Rocker arm 248 rocks about a fulcrum 270 attached to an engine block 272. In a preferred embodiment, piston 238 is a pneumatic pump, and piston 240 is an internal combustion engine piston.

Piston engine 232 has first and second pistons 276, 278, that operate in line but oppose each other. Pistons 276 and 278 are connected to a first and second eccentric 280, 284, each at one end of a rocker arm 286, 288, pivotally attached at first and second pivots points to an engine block 292. The opposing ends of rocker arms 286, 288, are pivotally connected to first and second connecting links 298, 300, that connect via crank arms 304, 306 to a single crankshaft 308 to rotate crankshaft 308, assisted by counter weights 310, 312.

It will be clear from these examples that many engine configurations are possible, either to meet spatial requirements and limitations or to produce more efficient engines. Engines of 2 and 4 cylinders may be symmetric or asymmetric. Inline piston engines such as those of engines 230 and 232, and particularly the latter, may be of special interest because each piston pushes against another piston rather than the cylinder walls. Thus, the present improved engine can be developed in accordance with the teachings herein to produce more efficient engines and different engine configurations. These engines can be pumps, steam engines, combustion engines using various fuels based on the source of expanding fluid for pushing against the cylinder in the case of engines or the source of power for rotating the crankshaft in the case of pumps.

It is intended that the scope of the present invention include all modifications that incorporate its principal design features, and that the scope and limitations of the present invention are to be determined by the scope of the appended claims and their equivalents. It also should be understood, therefore, that the inventive concepts herein described are interchangeable and/or they can be used together in still other permutations of the present invention, and that other modifications and substitutions will be apparent to those skilled in the art from the foregoing description of the preferred embodiments without departing from the spirit or scope of the present invention.

What is claimed is:

1. An engine, comprising:

an engine block having a hole formed therein;

a piston carried within said engine block and dimensioned for reciprocal motion within said hole of said engine block, said piston having a piston head and a rod extending therefrom, said rod having a first end attached to said piston head and an opposing second end;

a rocker arm having a fulcrum defining a first portion and an opposing second portion, said first and said second portions being pivotable about said fulcrum, said rocker arm having a pivot hole formed at said fulcrum, said first portion having a first end, said second portion having a second end, said first end of said first portion having a hole formed therein;

a pivot pin carried in said pivot hole in said rocker arm and attached to said engine block so that said rocker arm can pivot with respect to said engine block about said pivot pin;

an eccentric dimensioned to fit in said hole of said first end of said first portion of said rocker arm, said eccentric rotating about an axis, said second end of said piston rod being attached to said eccentric at a location spaced apart from said axis of said eccentric so that, as said piston rod reciprocates, said second end of said piston rod rotates about said axis of said eccentric and causes said rocker arm to pivot about said pivot pin;

a connecting link having a first end and an opposing second end, said first end being connected to said second portion of said rocker arm, said connecting link reciprocating when said rocker arm pivots about said pivot pin in response to reciprocal motion of said piston rod; and a crankshaft having a counterweight and a crank arm, said crank arm being attached to said second end of said connecting link so that when said connecting link reciprocates, said connecting link rotates said crankshaft.

2. The engine as recited in claim 1, wherein said first portion and said second portion have different lengths with respect to said fulcrum.

3. The engine as recited in claim 2, wherein said length of said first portion is shorter than said length of said second portion.

4. The engine as recited in claim 3, wherein said piston has a stroke and said crank arm travels an arcuate distance, and wherein said arcuate distance is greater than 1.57 times said stroke.

5. The engine as recited in claim 1, wherein said piston has a down stroke at the first part of a cycle, and wherein said fulcrum and said connecting arm are arranged so that said piston pushes said connecting arm on said down stroke.

6. The engine as recited in claim 1, wherein said first portion and said second portion are arranged at an angle of less than 180° with respect to each other.

7. The engine as recited in claim 1, wherein said major axis of said piston rod is at an angle other than 180° with respect to said connecting link.

8. The engine as recited in claim 1, wherein said location at which said piston rod is attached to said eccentric is dimensioned so that said piston dwell at top dead center is longer than at bottom dead center.

9. The engine as recited in claim 1, wherein said rocker arm is dimensioned so that said piston dwell at top dead center is longer than at bottom dead center.

10. The engine as recited in claim 1, wherein said piston lies in a plane with respect to said eccentric and wherein said plane is selected so that said piston dwell at top dead center is longer than at bottom dead center.

11. The engine as recited in claim 1, wherein said rocker arm is dimensioned so that said piston dwell at top dead center is the same as at bottom dead center.

12. An engine, comprising:

a engine block having at least one hole formed therein;

at least one piston carried within said engine block, each piston of said at least one piston being dimensioned for reciprocal motion within a hole of said at least one hole in said engine block, each piston of said at least one piston having a piston head and a rod extending therefrom, said rod having a first end attached to said piston head and an opposing second end;

at least one rocker arm, each rocker arm of said at least one rocker arm having a fulcrum defining a first portion and an opposing second portion, said first and said second portions being pivotable about said fulcrum, said each rocker arm having a pivot hole formed at said fulcrum, said first portion having a first end, said second portion having a second end, said first end of said first portion having a hole formed therein, and said each rocker arm having a pivot pin carried in said pivot hole in said each rocker arm, said pivot pin being attached to said engine block so that said each rocker arm can pivot with respect to said engine block about said pivot pin, said each rocker arm having an eccentric rotatably mounted in said hole of said first end of said first portion, said eccentric rotating about an axis, said second end of said piston rod being attached to said eccentric at a location spaced apart from said axis of said eccentric so that, as said piston rod reciprocates, said second end of said piston rod rotates about said axis of said eccentric and causes said each rocker arm to pivot about said pivot pin;

at least one connecting link, each connecting link of said at least one connecting link having a first end and an opposing second end, said first end of said each connecting link being connected to said second portion of said each rocker arm, said each connecting link reciprocating when said each rocker arm pivots about said pivot pin in response to reciprocal motion of said piston rod; and a crankshaft having a counterweight and at least one crank arm, each crank arm of said at least one crank arm being attached to said second end of said each connecting link of said at least one connecting link so that when said each connecting link reciprocates, said each crank arm rotates said crankshaft.

13. The engine as recited in claim 12, wherein said at least one piston further comprises two pistons.

14. The engine as recited in claim 13, wherein said two pistons are asymmetrically arranged.

15. The engine as recited in claim 13, wherein said pistons are in line.

16. The engine as recited in claim 13, wherein said at least one rocker arm is one rocker arm.

17. The engine as recited in claim 13, wherein said at least one piston further comprises four pistons.

18. The engine as recited in claim 17, wherein said four pistons are asymmetrically arranged.

19. The engine as recited in claim 17, further comprising a source of expanding fluid for reciprocating said at least one piston.

20. The apparatus as recited in claim 17, further comprising means for rotating said crankshaft, and wherein said at least one piston is adapted to pump a fluid.

* * * * *